US006908246B2

(12) United States Patent
Kageyama et al.

(10) Patent No.: US 6,908,246 B2
(45) Date of Patent: Jun. 21, 2005

(54) MECHANICAL PENCIL

(75) Inventors: Hidehei Kageyama, Kawagoe (JP); Yoshio Noguchi, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/040,491

(22) Filed: Jan. 9, 2002

(65) Prior Publication Data

US 2002/0090248 A1 Jul. 11, 2002

(30) Foreign Application Priority Data

Jan. 10, 2001 (JP) ..... 2001-003113

(51) Int. Cl.[7] ..... B43K 21/22; A45D 40/02
(52) U.S. Cl. ..... 401/92; 401/86; 401/87
(58) Field of Search ..... 401/65, 67, 81, 401/85–87, 89, 92–94

(56) References Cited

U.S. PATENT DOCUMENTS 4,714,365 A 12/1987 Kageyama et al. ..... 401/65
5,462,376 A 10/1995 Kageyama et al. ..... 401/65
6,234,697 B1 * 5/2001 Kanari et al. ..... 401/92

FOREIGN PATENT DOCUMENTS

EP 0 709 233 A1 5/1996

* cited by examiner

*Primary Examiner*—David J. Walczak
(74) *Attorney, Agent, or Firm*—McGinn & Gibb, PLLC

(57) ABSTRACT

A mechanical pencil includes a barrel, a lead feeding mechanism disposed in the barrel to tighten and feed a lead, and a lead holder disposed between the lead feeding mechanism and a tip end of the barrel. The lead holder includes a through hole through which the lead penetrates, holding portions for holding the lead, and a contact portion for contacting an inner peripheral face of the barrel. The holding portions include a first holding portion at a front portion of the lead holder and a second holding portion at a rear portion of the lead holder. When a length of the lead becomes shorter than a distance between the lead feeding mechanism and the tip end of the barrel, the first holding portion holds the short lead and the second holding portion holds a next lead tightened by the lead feeding mechanism.

19 Claims, 2 Drawing Sheets

MECHANICAL PENCIL

BACKGROUND OF THE INVENTION

1. Field of the Invention

The present invention relates to a mechanical pencil and, more particularly, to a mechanical pencil in which a lead can be used effectively and the remainder lead can be shortened.

2. Description of the Related Art

In a conventional mechanical pencil having a barrel, a lead feeding mechanism disposed in the barrel to tighten and feed a lead, a lead holder disposed on the tip end side of the lead feeding mechanism to hold the lead penetrating therethrough, and an operating part for causing the lead feeding mechanism to feed the lead, the lead is normally tightened by the lead feeding mechanism. Thus, the lead is prohibited from moving.

When the lead is projected from the tip end of the barrel at the time of writing, the operating part is operated to cause the lead feeding mechanism to feed the lead. At this time, since the lead is held by the lead holder, the lead that has been fed a predetermined amount during the lead feeding operation by the lead feeding mechanism, is prevented from retreating (e.g., retracting) together with the lead feeding mechanism when the lead feeding mechanism returns. Since the lead feeding mechanism tightens the lead after returning, the lead projecting from the tip end of the barrel is used for writing without being retreated (retracted) by a writing force.

However, in the above-mentioned conventional mechanical pencil, when the lead is consumed, and thus the length thereof becomes shorter than a distance from the lead feeding mechanism to the tip end of the barrel, the lead is undesirably released from the tightening of the lead feeding mechanism. Thus, there arises a problem in that the consumed lead cannot be used effectively.

Specifically, for example, when the consumed lead is fed, the next lead is fed by the lead feeding mechanism so that the consumed lead is pushed out by using the next lead. However, since the next lead is not held by the lead holder, the feeding of lead is not performed completely, so that the consumed lead cannot be pushed out surely in some cases. In particular, when the lead is fed in an upward position of the pencil, such a phenomenon often occurs.

As a result, the lead that has become shorter than the distance from the lead feeding mechanism to the tip end of the barrel cannot be used sufficiently, and therefore becomes a remainder lead, which leads to a waste of resources.

SUMMARY OF THE INVENTION

In view of the foregoing and other problems, drawbacks, and disadvantages of the conventional structures, an object of the present invention is to provide a mechanical pencil in which the length of remainder lead can be decreased greatly.

To achieve the above and other objects, a mechanical pencil according to the present invention includes a barrel, a lead feeding mechanism disposed in the barrel to tighten and feed a lead, and an operating part for causing the lead feeding mechanism to feed the lead. The holding portions for holding the lead are provided in at least two places between the lead feeding mechanism and the tip end of the barrel spacedly (e.g., in a spaced configuration) in the axial direction.

When the lead is consumed, and thus the length thereof becomes shorter than a distance between the lead feeding mechanism and the tip end of the barrel, the holding portion provided at the front in the axial direction of the holding portions provided in at least two places holds the consumed lead, and the holding portion provided at the rear in the axial direction holds the next lead.

Thus, when the next lead is fed by the lead feeding mechanism, the next lead is surely fed by the holding portion provided at the rear. Hence, the next lead fed surely pushes out the consumed lead, so that the consumed lead is surely fed. Thus, the consumed lead can be used sufficiently. Specifically, as long as at least the holding portion provided at the front can hold the consumed lead, the consumed lead can be used, so that the length of remainder lead can be decreased greatly.

Also, in the mechanical pencil, a lead holder having a through hole through which the lead penetrates can be provided closer to the tip end than the lead feeding mechanism in the barrel, and the holding portions are provided on the lead holder.

By providing the holding portions on the lead holder, the mechanical pencil can be manufactured without increasing the number of parts. Also, since at least two holding portions are provided on the lead holder spacedly in the axial direction, the axial length of the lead holder increases resultantly, so that the length of the penetrating lead surrounded by the lead holder increases. Therefore, unintended decentering of the lead can be prevented, and thus the lead is prevented from being broken.

The present disclosure relates to subject matter contained in Japanese Patent Application No. 2001-3113, filed on Jan. 10, 2001, which is expressly incorporated herein by reference in its entirety.

BRIEF DESCRIPTION OF THE DRAWINGS

The foregoing and other purposes, aspects and advantages of the present invention will become more fully understood from the detailed description given hereinbelow and the accompanying drawings which are given by way of illustration only, and thus are not limiting the present invention, wherein.

DETAILED DESCRIPTION OF THE PREFERRED EMBODIMENTS OF THE INVENTION

Figure 1:
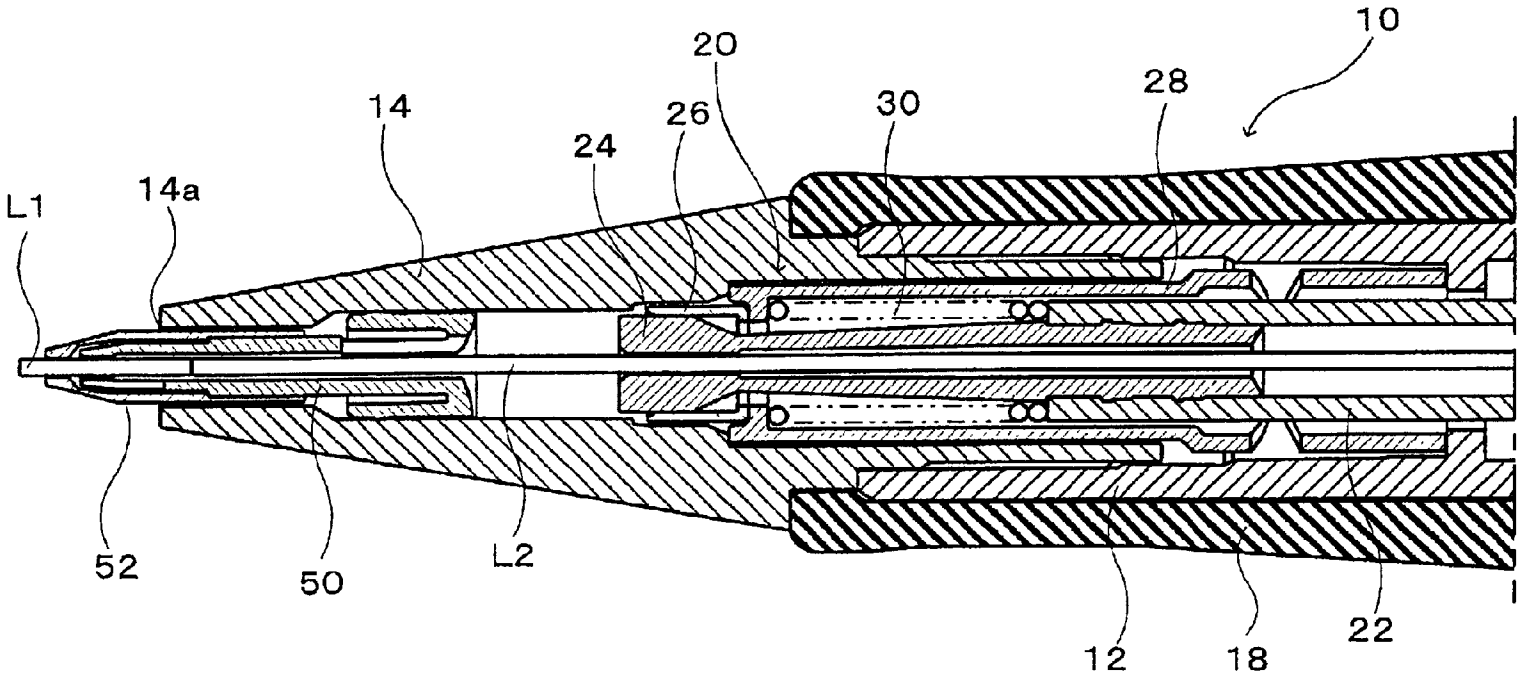
FIG. 1 is a longitudinal sectional view of an essential portion of a mechanical pencil in accordance with an embodiment of the present invention.
Figure 2:
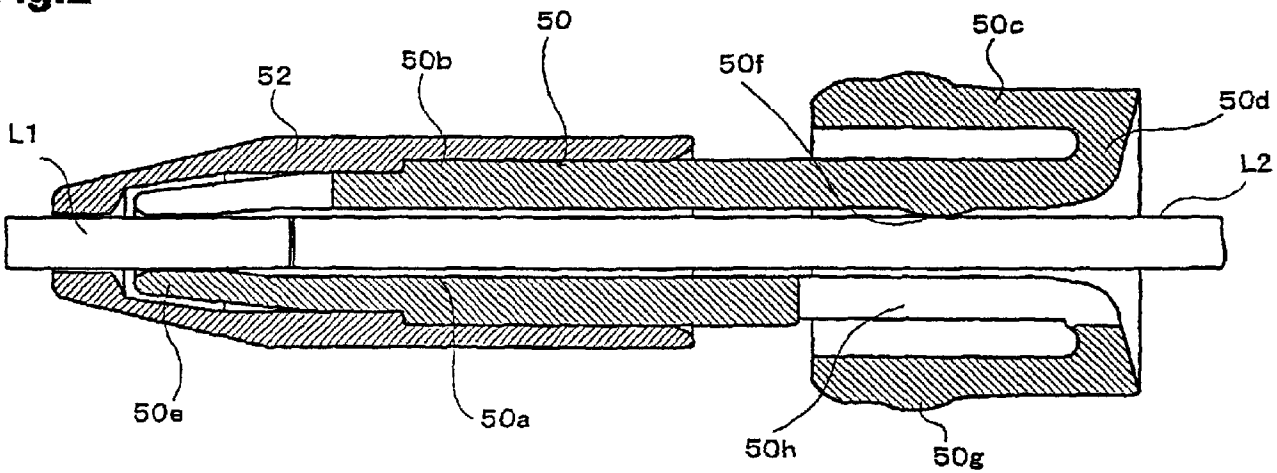
FIG. 2 is an enlarged sectional view of a tip end member 14 and a slider 50.
Figure 3:
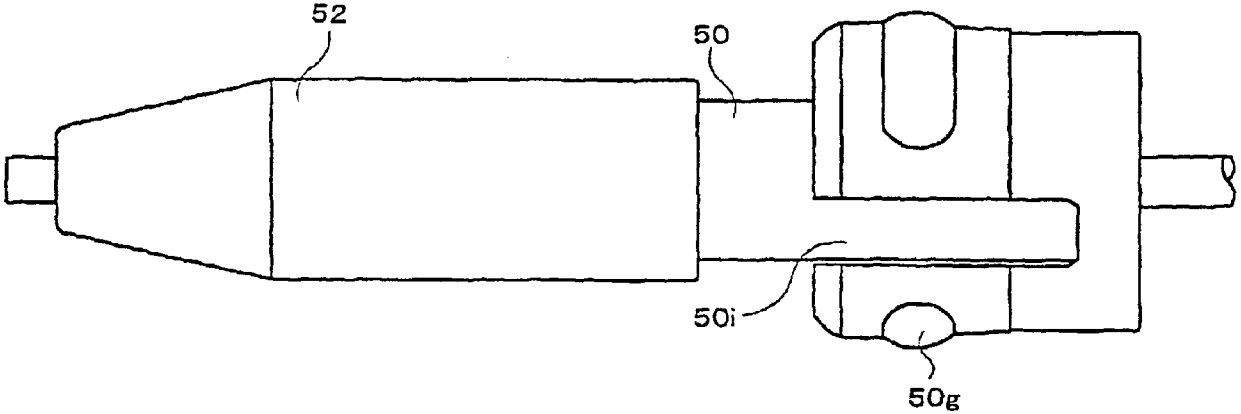
FIG. 3 is a plan view of FIG. 2.

An embodiment of the present invention will now be described with reference to the accompanying drawings. FIGS. 1 to 3 show an embodiment of the present invention.

Referring to FIG. 1, a mechanical pencil has mainly a barrel 10, a lead feeding mechanism 20 (e.g., writing medium feeding mechanism) disposed in the barrel 10 to tighten and feed a lead (e.a., a writing medium), a lead holder 50 (e.g., writing medium holder) disposed on the tip end side of the lead feeding mechanism 20 to hold the lead penetrating therethrough, and an operating part (not shown) for causing the lead feeding mechanism 20 to feed the lead.

The barrel 10 includes a front barrel 12, a tip end member 14 screwed into the front barrel 12, and a rear barrel (not shown). A gripper 18 made of an elastic material is mounted on the outer peripheral face of the front barrel 12. The front barrel 12, the tip end member 14, and the rear barrel can be formed integrally (e.g., a unitary construction), or can be formed of more parts than in this embodiment. An opening 14*a* at the tip end of the tip end member 14 serves as an opening at the tip end of the barrel 10 to allow the lead to pass through.

The lead feeding mechanism 20 can have any construction. In this embodiment, the lead feeding mechanism 20 includes a lead containing cylinder 22 for containing the lead, a chuck 24 fixed at the tip end of the lead containing cylinder 22 to tighten and feed the lead, a chuck ring 26 located around the outer periphery of the chuck 24 to tighten the chuck 24, a sleeve 28 for preventing the rearward movement of the chuck ring 26, and a chuck spring 30 located between the sleeve 28 and the lead containing cylinder 22 to urge the lead containing cylinder 22 and the chuck 24 rearward.

To the rear end of the lead containing cylinder 22 is detachably connected a rear end pushbutton, which is the operating part. By knocking the rear end pushbutton, the lead containing cylinder 22, the chuck 24, and the chuck ring 26 of the lead feeding mechanism 20 are advanced, by which the lead is fed a predetermined amount. The operating part is not limited to the rear end pushbutton, and can be a side lever provided on the side face of the barrel 10.

The tip end member 14 contains a slider 50 (e.g., which may be single-piece lead holder or single-piece writing medium holder), and a tip 52. In this embodiment, the tip 52 and the slider 50 can be slid in the axial direction, and the tip 52 and the slider 50 can be projected together with the lead from the opening 14*a* at the tip end member or can be retreated (retracted) into the opening 14*a* at the tip end. It is a matter of course that the tip 52 and the slider 50 need not be slidable in the axial direction, and that they can be applied to a mechanical pencil of a type such that the tip and the slider are not slidable in the axial direction.

As shown in greater detail in FIGS. 2 and 3, the slider 50 has a substantially cylindrical body 50*b* formed with a through hole 50*a* through which the lead penetrates, an outside cylinder 50*c* provided concentrically on the outside of the body 50*b* at the rear end part of the body 50*b*, and a connecting part 50*d* for connecting the outside cylinder 50*c* to the body 50*b* in the radial direction.

In the front end part of the body 50*b*, at least one blade 50*e* projecting in the inside diameter direction is formed, and also in the rear end part of the body 50*b*, a rib 50*f* projecting in the inside diameter direction is formed on the inner peripheral face of the through hole 50*a*. Also, a slit 50*h* is formed in a portion in which the rib of 50*f* is absent at the rear end part of the body 50*b* formed with the rib 50*f* of the slider 50. Thus, the rib 50*f* can be displaced elastically in the radial direction. Therefore, the blade 50*e* and the rib 50*f* form holding portions at two or more locations along an axial length of the writing medium holder 50.

Similarly, on the outer peripheral face of the outside cylinder 50*c*, a rib 50*g* projecting in the outside diameter direction is formed, and a slit 50*i* is formed in a portion in which the rib 50*g* of the outside cylinder 50*c* is absent. Thus, the rib 50*g* can be displaced elastically in the radial direction into contact with the inner surface of the (tip end member) of the barrel.

The blade 50*e* and the rib 50*f* come into contact with the lead passing through the through hole 50*a*, and thereby hold the lead with a proper holding force. Also, a contact portion includes the rib 50*g* of the outside cylinder 50*c* that comes into contact with the inner peripheral face of the tip end member 14, and thereby maintains the positional relationship with the tip end member 14 with a proper holding force. The blade 50*c* may be replaced with a rib similar to the rib 50*f*.

Although the slits 50*h* and 50*i* are not necessarily needed, a stable holding force can be obtained by the provision of slits 50*h* and 50*i*. The maximum static friction force generated between the rib 50*g* and inner peripheral face of the tip end member 14 is set to be larger than a sum of the maximum static friction force generated between the blade 50*e* and the lead, and the maximum static friction force generated between the rib 50*f* and the lead.

In the above-described mechanical pencil, when the lead is not consumed, the lead is held by the blade 50*e* and the rib 50*f* of the slider 50 in portions located ahead of a portion in which the lead is tightened by the chuck 24 of the lead feeding mechanism 20. The rest of the configuration of the pencil is the same as that of the conventional mechanical pencil, so that the explanation thereof is omitted.

When the lead is consumed, and thus the length thereof becomes shorter than a distance between the chuck 24 of the lead feeding mechanism 20 and the opening 14*a* at the tip end of the tip end member 14 as shown in FIGS. 1 and 2, a consumed lead L1 is held by the blade 50*e* of the slider 50, and the next lead L2 is held by the rib 50*f* of the slider 50. Therefore, the consumed lead L1 is prevented from dropping by the blade 50*e*.

When the operating part is operated in this state to feed the next lead L2 using the lead feeding mechanism 20, since the next lead L2 is held by the rib 50*f* of the slider 50, the lead L2 is surely fed by a predetermined amount without being pulled back together with the chuck 24 when the chuck 24 returns. Therefore, the consumed lead L1 is pushed out according to the fed amount, so that the consumed lead L1 can be fed surely. Even if the next lead L2 is fed in an upward position of the pencil, the consumed lead L1 is fed surely in the same way.

Since the consumed lead L1 can be used in this manner, the length of remainder lead can be decreased significantly (e.g., almost completely as shown in FIG. 2). Preferably, an axial distance between the blade 50*e* and the rib 50*f* is set as long as possible to hold the consumed lead L1 and the next lead L2. In this case, as a result, the length of the slider 50 is increased. Therefore, even if the lead is not consumed, the lead is protected against unintended decentering by the slider 50, so that the lead is prevented from being broken. It is noted that, instead of providing the blade 50*e* and the rib 50*f* on one component as holding portions as in the above-described embodiment, each of these elements can be provided on an individual separate component.

As explained earlier, the slider 50 is axially slidable within the tip end member 14 of the barrel 10 and, as is clearly illustrated in FIG. 1, the rib 50*b* on the outside cylinder 50*c* maintains frictional contact throughout the entire axially slidable extent. In other words, the slider 50 always maintains a stable holding force within the tip end member 14 of the barrel. It is at least this feature that ensures that the lead L2 is surely fed by a predetermined amount without being pulled back together with the chuck 24 when the chuck 24 returns as described above.

With the invention being thus described, it will be obvious that the same may be varied in many ways. Such variations are not to be regarded as a departure from the spirit and scope of the invention, and all such modifications as would be obvious to one skilled in the art intended to be included within the scope of the following claims.

For example, while the above described embodiment has been exemplarily described with respect to a mechanical pencil having a lead, other writing instruments having a consumable writing medium and which rely on the consumable writing medium being held by a holding portion, could find great benefit with the invention.

What is claimed is:

1. A mechanical pencil, comprising:

a barrel;

a lead feeding mechanism disposed in said barrel to tighten and feed a lead; and a single-piece lead bolder disposed between the lead feeding mechanism and a tip end of said barrel, said single-piece lead holder having a through hole through which the lead penetrates and comprising:

holding portions, for holding the lead;

a contact portion for contacting an inner peripheral surface of the barrel; and a body, said holding portions including a first holding portion at a front portion of the lead holder and a second holding portion at a rear portion of the lead holder, the holding portions fixing the lead relative to the barrel during writing, a maximum static friction force generated between the lead holder and an inner peripheral surface of said barrel is set to be larger than a maximum static friction force generated between the holding portions and the lead, so that when a length of the lead becomes shorter than a distance between the lead feeding mechanism and the tip end of said barrel, said first holding portion holds the short lead and said second holding portion holds a next lead tightened by the lead feeding mechanism, wherein said contact portion comprises an outside cylinder provided concentrically on an outside of the body, wherein said outside cylinder comprises a rib projecting in an outside diameter direction to come into contact with said inner peripheral surface of the barrel, and wherein a slit is formed in a portion of the outside cylinder in which the rib of the outside cylinder is absent so that said rib is elastically displaceable radially outwardly into contact with said inner peripheral surface of the barrel.

2. The mechanical pencil according to claim 1, wherein at least one of said holding portions of said body comprises at least one blade that projects in an inside diameter direction in a front end part of said body to come into contact with the lead.

3. The mechanical pencil according to claim 1, wherein at least one of said holding portions of said body comprises a rib that projects in an inside diameter direction in a rear end part of said body to come into contact with the lead.

4. A writing instrument, comprising:

a barrel;

a writing medium feeding mechanism disposed in said barrel to be adapted to tighten and feed a writing medium; and a single-piece writing medium holder disposed between the writing medium feeding mechanism and a tip end of said barrel, said writing medium holder having a through hole through which the writing medium penetrates and comprising:

holding portions for holding the writing medium;

a contact portion for contacting an inner peripheral surface of the barrel; and a body, said holding portions including a first holding portion at a front portion of the writing medium holder and a second holding portion at a rear portion of the writing medium holder, the holding portions fixing the writing medium relative to the barrel during writing, a maximum static friction force generated between the writing medium holder and an inner peripheral surface of said barrel is set to be larger than a maximum static friction force generated between the holding portions and the writing medium, so that when a length of the writing medium becomes shorter than a distance between the writing medium and the tip end of said barrel, said first holding portion holds the short writing medium and said second holding portion holds a next writing medium tightened by the writing medium feeding mechanism, wherein said contact portion comprises an outside cylinder provided concentrically on an outside of the body, wherein said outside cylinder comprises a rib projecting in an outside diameter direction to come into contact with said inner peripheral surface of the barrel, and wherein a slit is formed in a portion of the outside cylinder in which the rib of the outside cylinder is absent so that said rib is elastically displaceable radially outwardly into contact with said inner peripheral surface of the barrel.

5. The instrument of claim 4, wherein the slit obtains a stable holding force on said lead.

6. The writing instrument according to claim 4, wherein at least one of said holding portions of said body comprises at least one blade that projects in an inside diameter direction in a front end part of said body to come into contact with the writing medium.

7. The writing instrument according to claim 4, wherein at least one of said holding portions of said body comprises a rib that projects in an inside diameter direction in a rear end part of said body to come into contact with the writing medium.

8. The writing instrument according to claim 7, wherein a slit is formed in a portion in which the rib is absent at the rear end part of the body.

9. The writing instrument according to claim 4, wherein said holding portions comprise a blade and a rib which come into contact with the writing medium passing through the through hole.

10. The writing instrument according to claim 9, wherein the blade is in a front end part of said body, and the rib is in a rear end part of said body.

11. A writing instrument, comprising:

a tip end of a barrel; and a single-piece writing medium holder held by said tip end of said barrel having a through hole through which a writing medium penetrates, and comprising holding portions for holding the writing medium, said holding portions being formed at two or more positions along an axial length of said writing medium holder, said holding portions including a first holding portion at a front portion of the single-piece writing medium holder and a second holding portion at a rear portion of the single-piece writing medium holder;

a body, and an outside cylinder provided concentrically on an outside of the body, wherein when a length of the writing medium becomes short, said first holding portion holds the writing medium and said second holding portion holds an unused writing medium, wherein said outside cylinder comprises a rib projecting in an outside diameter direction to come into contact with an inner peripheral surface of the barrel, and wherein a slit is formed in a portion of the outside cylinder in which the rib of the outside cylinder is absent, wherein said rib is elastically displaceable radially outwardly into contact with the inner peripheral surface of the barrel, and the holding portions fixing the writing medium relative to the barrel during writing, a maximum static friction force generated between the writing medium holder and an inner peripheral surface of said barrel is set to be larger than a maximum static friction force generated between the holding portions and the writing medium.

12. The instrument of claim 11, wherein the slit obtains a stable holding force on said lead.

13. The pencil of claim 1, wherein the slit obtains a stable holding force on said lead.

14. A writing instrument, comprising:

a barrel;

a writing medium feeding mechanism disposed in said barrel to be adapted to tighten and feed a writing medium; and a single-piece writing medium holder disposed between the writing medium feeding mechanism and a tip end of said barrel, said writing medium holder being axially slidable within said barrel, having a through hole through which the writing medium penetrates and comprising:

holding portions for holding the writing medium; and a contact portion for contacting an inner peripheral surface of the barrel, said holding portions including a first holding portion at a front portion of the writing medium holder and a second holding portion at a rear portion of the writing medium holder, the holding portions fixing the writing medium relative to the barrel during writing, a maximum static friction force generated between the writing medium holder and an inner peripheral surface of said barrel is set to be larger than a maximum static friction force generated between the holding portions and the writing medium, so that when a length of the writing medium becomes shorter than a distance between the writing medium and the tip end of said barrel, said first holding portion holds the short writing medium and said second holding portion holds a next writing medium tightened by the writing medium feeding mechanism, wherein said contact portion comprises an outer peripheral surface that is elastically displaceable radially outwardly into contact with said inner peripheral surface of the barrel, and wherein said contact portion maintains frictional contact with said inner peripheral surface of the barrel throughout the axially slidable extent.

15. The instrument of claim 14, wherein said single-piece writing medium holder further comprises a body and wherein said outer peripheral surface comprises an outside cylinder concentrically provided on an outside of said body.

16. The instrument of claim 15, wherein said outside cylinder comprises a rib that maintains contact with said inner peripheral surface of the barrel.

17. The instrument of claim 15, wherein said outside cylinder comprises a slit.

18. The instrument of claim 15, wherein said body comprises a cylindrical body.

19. The instrument of claim 18, wherein said single-piece writing medium holder further comprises a connecting part at a rear of said single-piece writing medium holder that connects said outside cylinder to said cylindrical body.

* * * * *